US007044300B2

(12) United States Patent
Tamai

(10) Patent No.: US 7,044,300 B2
(45) Date of Patent: May 16, 2006

(54) PACKAGING CONTAINER FOR CONTAINING PLURAL ROLLS OF STRIP MATERIAL

(75) Inventor: Kyoshi Tamai, Kanagawa (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 109 days.

(21) Appl. No.: 10/259,305

(22) Filed: Sep. 30, 2002

(65) Prior Publication Data

US 2003/0066773 A1 Apr. 10, 2003

(30) Foreign Application Priority Data

Sep. 28, 2001 (JP) ..... 2001-299511

(51) Int. Cl.
*B65D 85/67* (2006.01)

(52) U.S. Cl. ..... 206/395; 206/391; 206/407; 206/499

(58) Field of Classification Search ..... 206/499, 206/386, 600, 455, 389, 391, 395, 403, 404, 206/407, 445; 229/122.29, 122.27, 125.28, 229/165, 200, 123.2, 122.31

See application file for complete search history.

(56) References Cited

U.S. PATENT DOCUMENTS

| | | | | |
|---|---|---|---|---|
| 1,262,992 | A * | 4/1918 | Stephano | 206/264 |
| 2,286,010 | A * | 6/1942 | Rabkin | 396/360 |
| 2,736,485 | A * | 2/1956 | Rabby | 229/110 |
| 5,163,556 | A | 11/1992 | Akao et al. | |
| 5,193,740 | A * | 3/1993 | Newborough et al. | 229/242 |
| 5,409,114 | A * | 4/1995 | Myers et al. | 206/394 |
| 5,441,154 | A * | 8/1995 | Youell, III | 206/599 |
| 5,457,938 | A * | 10/1995 | Butterfield et al. | 53/399 |
| 6,446,859 | B1 * | 9/2002 | Holladay | 229/109 |
| 6,502,698 | B1 * | 1/2003 | McKenna et al. | 206/509 |

FOREIGN PATENT DOCUMENTS

| | | | |
|---|---|---|---|
| EP | 1142793 A1 | * | 10/2001 |
| GB | 2276147 A | * | 9/1994 |
| JP | 11-245944 A | | 9/1999 |
| WO | WO 97/18133 | * | 5/1997 |

* cited by examiner

*Primary Examiner*—David T. Fidei
*Assistant Examiner*—J. Gregory Pickett
(74) *Attorney, Agent, or Firm*—Sughrue Mion, PLLC

(57) ABSTRACT

A packaging container contains plural roll containing wrappers, which have rolls of motion picture photo film. An upper case has a lower opening at a lower end, for containing the plural roll containing wrappers. A lower end panel closes the lower opening. Four through holes is formed in the upper case. Four connection tabs are formed to protrude from the lower end panel, retained in the four through holes, for connecting the lower end panel with the upper case.

13 Claims, 11 Drawing Sheets

PACKAGING CONTAINER FOR CONTAINING PLURAL ROLLS OF STRIP MATERIAL

BACKGROUND OF THE INVENTION

1. Field of the Invention

The present invention relates to a packaging container for containing plural rolls of strip material. More particularly, the present invention relates to a packaging container in which a plurality of roll containing wrappers with the rolls of strip materials can be treated easily in a collective manner, and can be preserved in a state laid on one another.

2. Description Related to the Prior Art

A photosensitive material strip is wound about a reel, to form a strip roll, in which a leading end of the photosensitive material strip is fastened to an outermost turn with a tape. The strip roll is contained in a light-tight wrapper or bag. A plurality of roll containing wrappers are packaged to obtain a roll package. U.S. Pat. No. 5,163,556 (corresponding to JP-Y 2510570) discloses a method of producing the roll package. A sheet of containerboard and a polypropylene resin sheet are placed on a pallet made of wooden material. A column-shaped member is disposed erectly at the center of an upper surface of the pallet. A hole of the reel of the strip roll is set to receive insertion of the column-shaped member, to place the strip roll on the polypropylene resin sheet. After a plurality of the strip rolls is placed, the roll containing wrappers of the strip rolls are enclosed in the light-tight wrapper or bag. A frame-shaped set of four side panels of the containerboard is prepared, and loaded with the roll containing wrappers, before a lid of the containerboard is fitted for closing. Those elements with the wooden pallet is fastened as a single package by winding a fastening belt.

JP-A 11-245944 discloses another example of the roll package. A lower end panel of the containerboard is mounted n a pallet for the purpose of facilitating operation of packaging. A group of the roll containing wrappers of the strip rolls is placed on the lower end panel. In the group of the roll containing wrappers, the light-tight wrapper or bag contains the strip roll. The roll containing wrappers are laid on one another. Then the set of the side panels of the containerboard is inserted in a space between the lower end panel and the roll containing wrappers, loaded with the roll containing wrappers, before an upper end panel or lid of the containerboard is fitted. The set of the side panels is fastened to the lower end panel by a plastic joint stopper. Also, the set of the side panels is fastened to the upper end panel or lid by use of a tape.

However, the roll package according to U.S. Pat. No. 5,163,556 (corresponding to JP-Y 2510570) has the sheet of the containerboard, the polypropylene resin sheet and the light-tight wrapper or bag, which are produced from different materials. The roll package according to JP-A 11-245944 includes has the joint stopper of plastic material, the tape and the like, which are different materials. It is highly difficult and laborious to classify those elements before abandonment. Also, the numbers of the parts are very high. Thus, operation of producing the package and opening the same requires complicated operation.

SUMMARY OF THE INVENTION

In view of the foregoing problems, an object of the present invention is to provide a packaging container for containing plural rolls of strips, in which a plurality of roll containing wrappers with the rolls of strips can be treated easily in a collective manner, can be preserved in a state laid on one another, and after the use, can be discarded only by simple operation.

In order to achieve the above and other objects and advantages of this invention, a packaging container for containing a roll group constituted by a stack of plural rolls of strip material includes a lower case section for placement of the roll group thereon. A lateral section is disposed about the roll group, has a lower portion fitted on the lower case section. An upper case section covers an upper portion of the roll group. Plural through holes are formed in the lateral section. Plural connection tabs are formed by cutting a portion of the lower case section along cut lines, to extend from an upper end of the lower case section, for being inserted in the through holes to connect the lower case section with the lateral section.

In a preferred embodiment, a container case has a lower opening at a lower end, for containing the plural rolls. A lower end panel closes the lower opening. At least one through hole is formed in the container case. At least one connection tab is formed to protrude from the lower end panel, retained in the through hole, for connecting the lower end panel with the container case.

The plural rolls are contained in respectively roll containing wrappers, and the container case contains the roll containing wrappers.

The at least one through hole comprises at least first and second through holes, and the first through hole is formed in a position opposite to the second through hole with reference to the plural roll containing wrappers. The at least one connection tab comprises at least first and second connection tabs, and the first connection tab is formed in a position opposite to the second connection tab with reference to the plural roll containing wrappers.

The connection tab includes a support portion, having a first width, for extending from the lower end panel. A hook portion is formed to protrude from an end of the support portion, having a second width greater than the first width, for being inserted in the through hole to retain the lower end panel.

The container case includes an upper end panel. First, second, third and fourth side panels are formed on a periphery of the upper end panel, to project downward.

The first through hole is formed in the first side panel, the third side panel is opposed to the first side panel, and the second through hole is formed in the third side panel. The lower end panel has first, second, third and fourth side lines associated with the first to fourth side panels, the first connection tab is disposed on the first side line, and the second connection tab is disposed on the third side line.

The container case and the lower end panel is constituted by containerboard.

The lower end panel and the upper end panel are constituted by double-face containerboard, and the first to fourth side panels are constituted by double-wall containerboard.

The through hole includes a retention gap portion, having a first size that is equal to or greater than the first width and smaller than the second width, for receiving the support portion coming through, to prevent the hook portion from dropping away. A passage gap portion is formed to extend from the retention gap portion, having a second size that is equal to or greater than the second width, for receiving passage of the hook portion, and for initially receiving insertion of the support portion. A gap closing projection is formed to project from an edge of the passage gap portion, for closing the passage gap portion after the support portion is set from the passage gap portion to the retention gap portion, to prevent the hook portion from shifting back to the passage gap portion.

The first to fourth side panels have an upper end, and have such a height that the upper end is level with or higher than an upper end of the plural roll containing wrappers.

Furthermore, four upward extending panels are formed to protrude upwards from a periphery of the lower end panel. At least one tear line is formed in one of the upward extending panels by providing a line of weakness, for tearing of the one upward extending panel therewith, to remove the plural roll containing wrappers.

The tear line includes a perforated tear line.

In a preferred embodiment, a reinforcing pad sheet is disposed between the lower end panel and the plural roll containing wrappers. At least one reinforcing tab is formed to protrude from the reinforcing pad sheet, extended on an inside of the connection tab, for being retained in the through hole, to connect the reinforcing pad sheet with the container case.

Furthermore, first and second pad flaps protrude from first and second side lines of the reinforcing pad sheet opposed to one another, to extend along an inside of the upward extending panels. The at least one reinforcing tab is first and second reinforcing tabs for protruding from respectively the first and second pad flaps.

Furthermore, third and fourth pad flaps protrude from third and fourth side lines of the reinforcing pad sheet opposed to one another. Plural holes are formed in the third and fourth pad flaps, have an edge, the edge being raised upon external operation of moving up the reinforcing pad sheet for removal from the lower end panel.

In another preferred embodiment, the first to fourth side panels are secured to the upper end panel.

A side panel set of the first to fourth side panels includes a first reinforcing panel portion for protruding from one vertical side line of the second side panel, to constitute the first side panel. A second reinforcing panel portion protrudes from one vertical side line of the fourth side panel, and is overlapped on the first reinforcing panel portion, to constitute the first side panel. A third reinforcing panel portion protrude from one remaining vertical side line of the second side panel, to constitute the third side panel. A fourth reinforcing panel portion protrudes from one remaining vertical side line of the fourth side panel, and is overlapped on the third reinforcing panel portion, to constitute the third side panel.

The first and second reinforcing panel portions and the second side panels are defined by bending a single first board material, and the third and fourth reinforcing panel portions and the fourth side panels are defined by bending a single second board material.

The at least one tear line includes a first pair of tear lines, formed in a first upward extending panel included in the four upward extending panels, for extending substantially in parallel with each other, to define a strip portion tearable away when moved away. Furthermore, four downward extending panels are formed to protrude downwards from a periphery of the upper end panel. A second pair of tear lines are formed in a first downward extending panel included in the four downward extending panels and opposed to the first upward extending panel, for extending substantially in parallel with each other, to define a strip portion tearable away when moved away, the second pair of the tear lines extending in a direction in which the first pair of the tear lines extend, for being torn to cut open the first downward extending panel.

Furthermore, a first reinforcing flap is formed to protrude from a free end of the first reinforcing panel potion, and opposed to a portion of the fourth side panel. A second reinforcing flap is formed to protrude from a free end of the fourth reinforcing panel potion, and opposed to a portion of the third side panel.

The upper end panel is shaped equally to the lower end panel, and the four downward extending panels are shaped equally to the four upward extending panels.

In still another preferred embodiment, the first to fourth side panels are formed to extend from the upper end panel, and the four downward extending panels are shaped equally to the four upward extending panels.

Furthermore, a pair of tear lines are formed in the first side panel by providing lines of weakness, for extending substantially in parallel with each other, to define a strip portion tearable away when moved away, for tearing of the first side panel therewith, to remove the roll containing wrappers.

The pair of the tear lines extend between the lower end panel and the upper end panel.

BRIEF DESCRIPTION OF THE DRAWINGS

The above objects and advantages of the present invention will become more apparent from the following detailed description when read in connection with the accompanying drawings, in which.

DETAILED DESCRIPTION OF THE PREFERRED EMBODIMENT(S) OF THE PRESENT INVENTION

Figure 1:
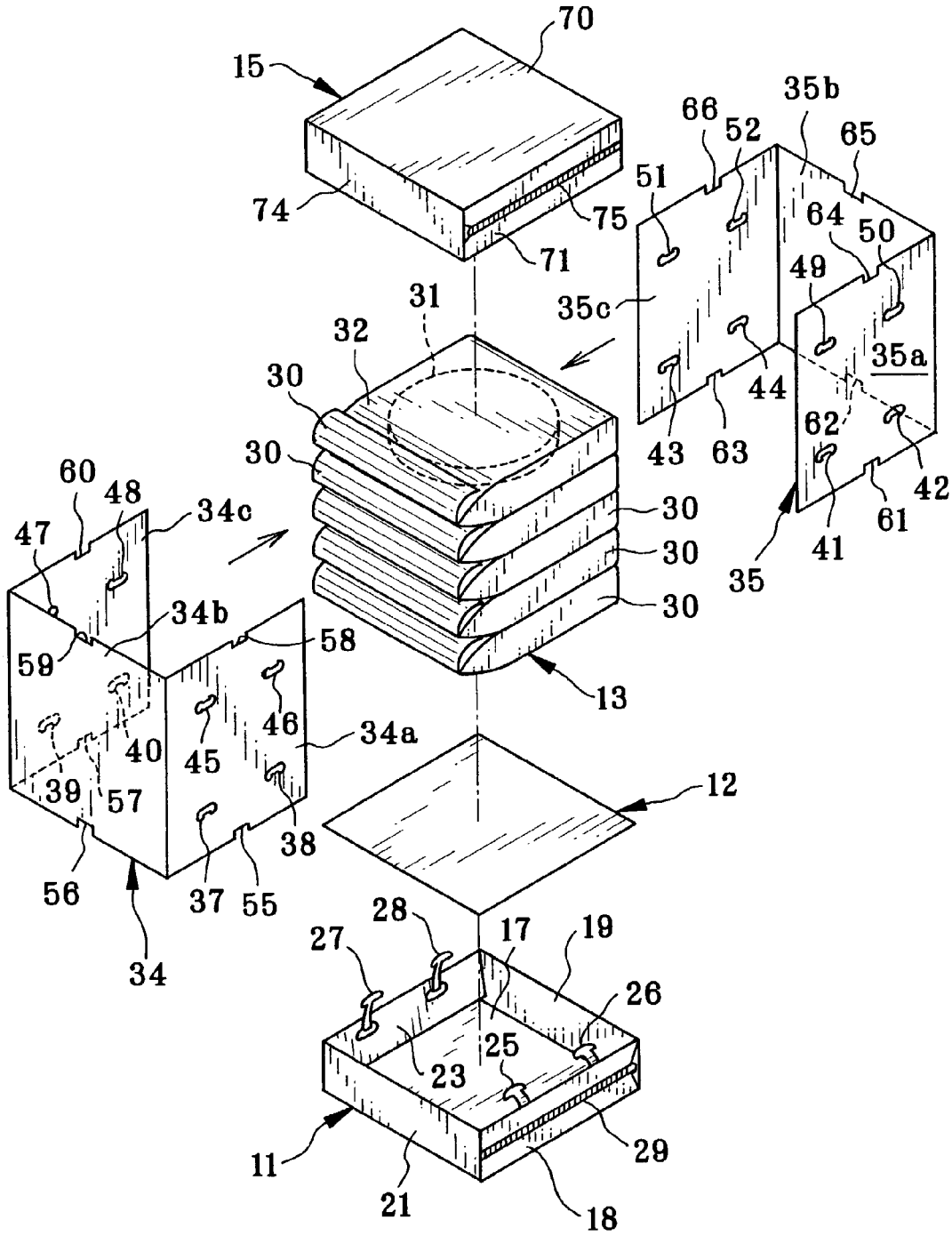
FIG. 1 is an exploded perspective illustrating a roll package of the present invention.
Figure 2:
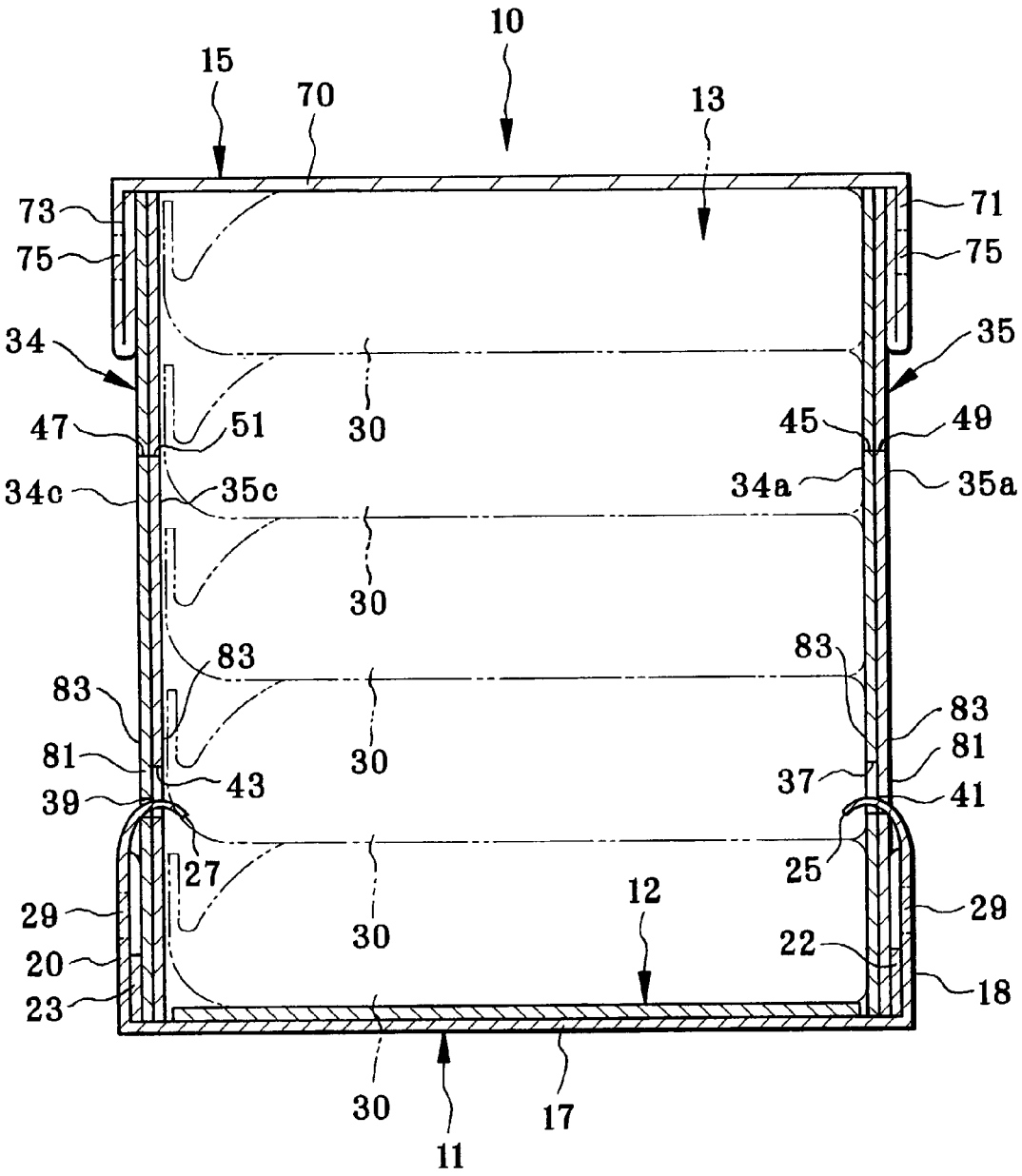
FIG. 2 is a cross section illustrating the roll package.

In FIGS. 1 and 2, a roll package 10 includes a lower case 11, a laminate paper board 12, a roll containing wrapper group 13, a lateral section 14 or side panel set, and an upper case 15 or upper end panel. Any of the lower case 11, the laminate paper board 12, the lateral section 14 and the upper case 15 is formed from containerboard or paper. The lateral section 14 and the upper case 15 constitute a container case.

The lower case 11 includes a lower end panel 17 and four upward extending panels 18, 19, 20 and 21 protruding from the periphery of the lower end panel 17. The laminate paper board 12 is placed on the lower end panel 17. Connection tabs 25 and 26 are formed to project from the upward extending panel 18, and connect the upward extending panel 18 to the lateral section 14. Also, connection tabs 27 and 28 are formed to project from the upward extending panel 20. A pair of tear lines 29 with patterned perforations are formed in each of the upward extending panels 18 and 20 for facilitating cutting the upward extending panels 18 and 20 at the time of tearing open the package. The tear lines 29 extend horizontally, to define a strip portion between those. The strip portion can be pulled out manually in a manner of a zipper, to tear away a top of the upward extending panels 18 and 20 from the lower case 11 to disconnect the lower case 11 from the lateral section 14. Note that perforated tear lines 19*g* and 21*g* in FIG. 4 may be formed in the upward extending panels 19 and 21, so that the upward extending panels 19 and 21 may be cut away without using any tool, and prevented from being obstruction in the course of destruction.

A plurality of roll containing wrappers 30 are combined to constitute the roll containing wrapper group 13. Each of the roll containing wrappers 30 includes a water-tight, light-tight wrapper 32 or bag and a photosensitive material strip roll 31 of a strip of photosensitive material, for example motion picture photo film, contained in the wrapper or bag 32. Preferable examples of the wrapper or bag 32 include laminate film within which a sheet of polyethylene resin foam is layered, and a light-tight bag having cushioning material.

Two board materials 34 and 35 are combined to constitute the lateral section 14, and have respectively a shape like a channel as viewed in section. The board material 34 includes a side panel 34*b* at the center, and two reinforcing panel portions 34*a* and 34*c* disposed on respectively ends of the side panel 34*b*. Similarly, the board material 35 includes a side panel 35*b* and two reinforcing panel portions 35*a* and 35*c*. Open sides of the channel shapes of the board materials 34 and 35 as viewed in section are opposed to each other. The reinforcing panel portion 34*a* is overlapped on the reinforcing panel portion 35*a*, the reinforcing panel portion 34*c* being overlapped on the reinforcing panel portion 35*c*. Thus, the lateral section 14 is formed to surround the roll containing wrapper group 13.

Lower ends of the board materials 34 and 35 are positioned on the inside of the upward extending panels 18–21 of the lower case 11. The board materials 34 and 35 have such a height as to extend slightly higher than the roll containing wrapper group 13. Through holes 37, 38, 39, 40, 41, 42, 43 and 44 are formed in the board materials 34 and 35 and positioned in lower portions of the reinforcing panel portions 34*a*, 34*c*, 35*a* and 35*c* for receiving insertion of the connection tabs 25–28. Note that through holes 45, 46, 47, 48, 49, 50, 51 and 52 are formed in the board materials 34 and 35 and positioned in upper portions of the reinforcing panel portions 34*a*, 34*c*, 35*a* and 35*c*, which are for the purpose of receiving insertion of the connection tabs 25–28 at the time that the board materials 34 and 35 are oriented upside down incidentally. The through holes 37–44 and the through holes 45–52 are so disposed in the reinforcing panel portions 34*a*, 34*c*, 35*a* and 35*c* as to overlap on one another when the board materials 34 and 35 are combined together. The lateral section 14 is inserted in the lower case 11 in such a direction that the reinforcing panel portions 34*a*, 34*c*, 35*a* and 35*c* are oriented toward surfaces having the connection tabs 25–28.

There are cutouts 55–66 formed in upper and lower edge portions of the board materials 34 and 35. After the package is torn open, the board materials 34 and 35 become waste and are discarded. After the board materials 34 and 35 are folded in a Z shape, the board materials 34 and 35 are bundled with a rope, belt or the like. To facilitate the abandonment, the cutouts 55–66 are used to receive the rope wound about the board materials 34 and 35 in the folded shape.

The upper case 15 or upper end panel is placed on the top of the lateral section 14, and used as a lid. The upper case 15 is structurally equal to the lower case 11. The upper case 15 includes an upper end panel portion 70 and downward extending panels 71, 73 and 74 protruding from the upper end panel portion 70 in the shape of a quadrangular prism. A pair of tear lines 75 are formed in the downward extending panel 71 of the upper case 15. To place the upper case 15 on the lateral section 14, the downward extending panel 71 with the tear lines 75 is directed equally to the upward extending panel 18 having the tear lines 29. An upper end of the lateral section 14 is set toward the inside of the downward extending panels 71, 73, and 74. Note that each of the downward extending panels 71 and 73 has the tear lines 75.

In the embodiment, the upper case 15 or upper end panel has a predetermined suitable size, is fitted on the lateral section 14 very tightly, and is not removable in a normal state. However, it is possible to shape the upper case 15 with a suitable small looseness in the size. The upper case 15 may be fixedly attached to the lateral section 14 by means of adhesive agent, adhesive tape or the like.

Figure 3:
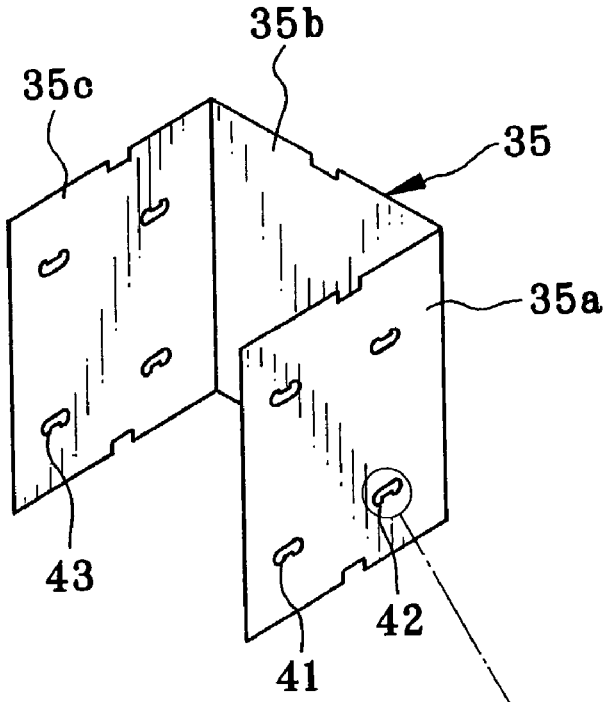
FIG. 3 is a perspective illustrating a through hole.
Figure 3A:
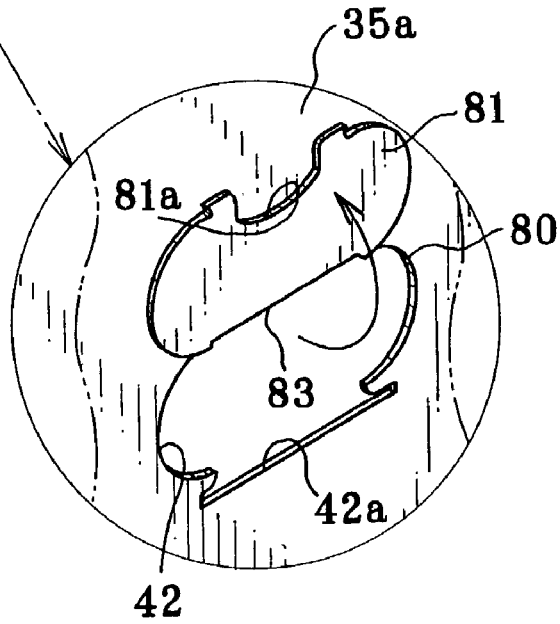
FIG. 3A is a perspective illustrating the same in enlargement.

In FIGS. 3 and 3A, a cut line 80 is formed in the reinforcing panel portion 35*a* by punching to form the through hole 42. A gap closing projection 81 or cut-open portion is bent out to open the through hole 42. A bend line 83 or hinge line is defined between ends of the cut line 80, and connects the gap closing projection 81 with the reinforcing panel portion 35*a*. The gap closing projection 81 is bent back to close the through hole 42 after inserting the connection tab 26, and fitted on the connection tab 26. The through holes 37–41 and 43–52 have a structure the same as the through hole 42. An access cutout 81*a* is formed in a free end portion of the gap closing projection 81 by punching for access of a finger for manual operation. A retention gap portion 42*a* is formed in an edge portion of the through hole 42 by punching, and operates for retaining each connection tab in a firmly fixed manner in cooperation with the gap closing projection 81.

Figure 4:
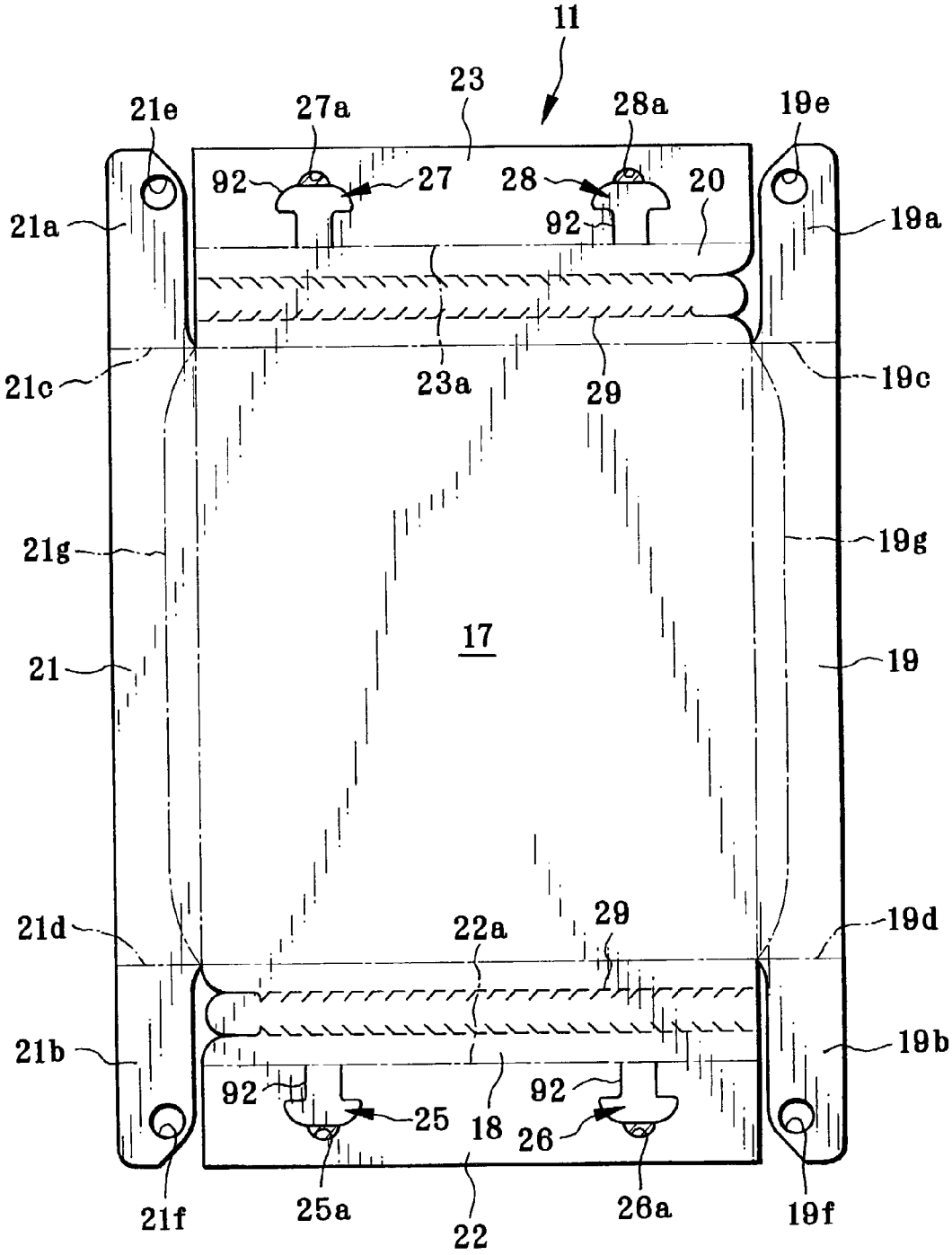
FIG. 4 is a development view illustrating a lower end panel.

In FIG. 4, the lower case 11 is one piece and shaped in a box form without connection-designated margins. Middle folding panels 22 and 23 extend from the upward extending panels 18 and 20. There are folding lines 22*a* and 23*a* along which the middle folding panels 22 and 23 are folded toward the inside of the upward extending panels 18 and 20, and fitted on their inner surfaces.

The connection tabs 25 and 26 are formed inside and connected with the middle folding panel 22. Also, the connection tabs 27 and 28 are formed inside and connected with the middle folding panel 23. Cut lines 92 are defined about the connection tabs 25–28, formed by punching, and causes the connection tabs 25–28 to be bent out.

Figure 5:
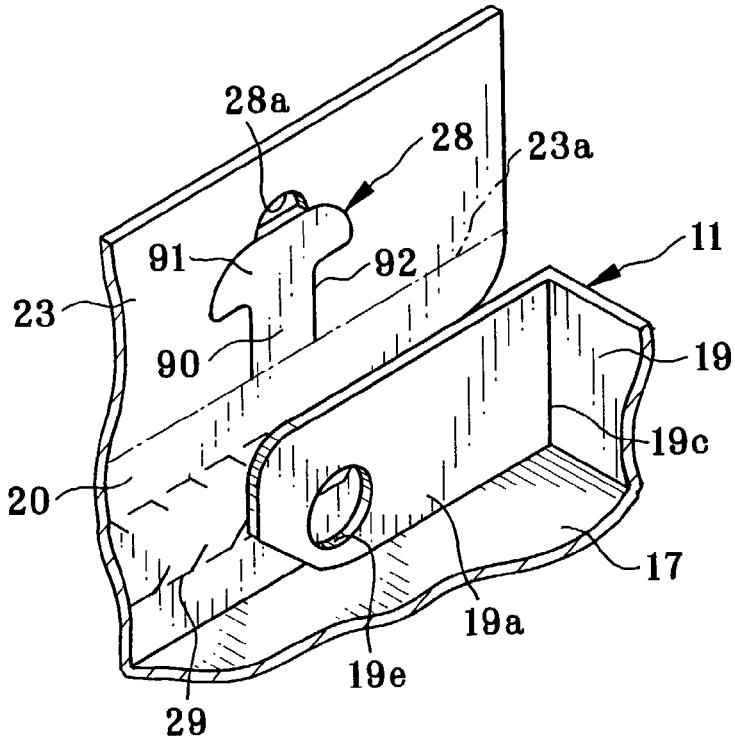
FIG. 5 is a perspective, partially broken, illustrating a middle folding panel in a state before being folded.

The upward extending panels 19 and 21 have bend flaps 19*a*, 19*b*, 21*a* and 21*b*. In FIG. 5, the bend flaps 19*a*, 19*b*, 21*a* and 21*b* are bent at 90 degrees along bend lines 19*c*, 19*d*, 21*c* and 21*d*, and squeezed between the middle folding panels 22 and 23 and the upward extending panels 18 and 20.

Each of the connection tabs 25–28 is constituted by a support portion 90 and a hook portion 91. The support portion 90 supports the hook portion 91, and held through the retention gap portion 42*a* when inserted through the through holes 37–44. The hook portion 91 projects from an end of the support portion 90, and includes retaining projections for being captured by an inside of the through holes 37–44 upon the insertion of the hook portion 91.

Figure 6:
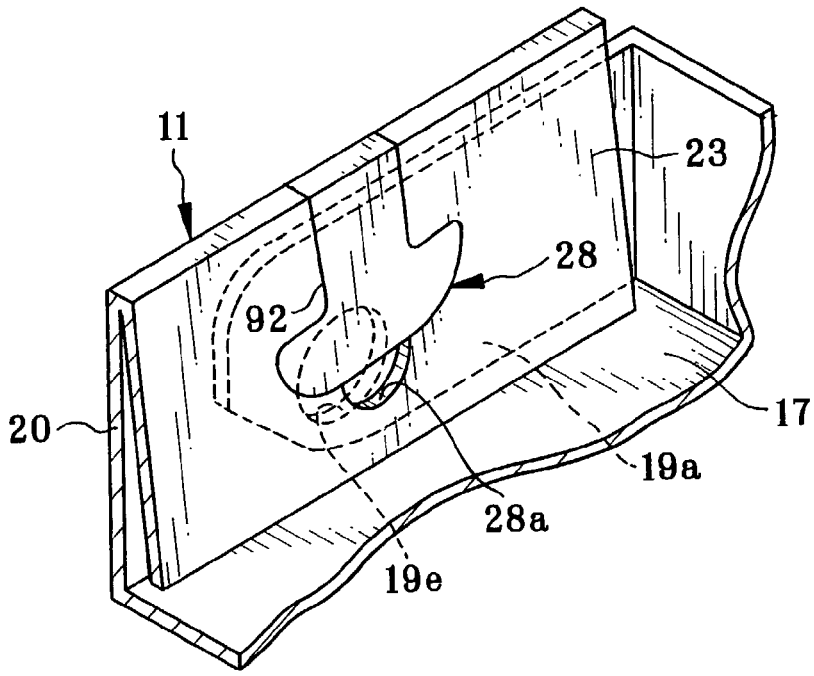
FIG. 6 is a perspective, partially broken, illustrating a middle folding panel in a folded state.

Access recesses 25*a*, 26*a*, 27*a* and 28*a* are formed at the same time of cutting the connection tabs 25–28 by punching, and are used for the purpose of inserting a finger. Note that the access recesses 25*a*–28*a* may be formed earlier than or later than cutting the connection tabs 25–28. The access recesses 25*a*, 26*a*, 27*a* and 28*a* are accessed by a finger in order to remove the connection tabs 25–28 from the hook portion 91. Access holes 19*e*, 19*f*, 21*e* and 21*f* are formed in respectively the bend flaps 19*a*, 19*b*, 21*a* and 21*b*. In FIG. 6, the access holes 19*e*, 19*f*, 21*e* and 21*f* are disposed at the inside of the access recesses 25*a*, 26*a*, 27*a* and 28*a* at the time of being squeezed between the upward extending panel 20 and the middle folding panel 23. This makes it possible to guide a user's finger toward the rear of the hook portion 91 at the time of removing the connection tabs 25–28 to prevent breakage.

The operation of the above embodiment is described now. The photosensitive material strip roll 31 is prepared, including the strip of photosensitive material and a plastic reel having the strip wound thereon. A leading end of the strip is attached to an outermost turn of the photosensitive material strip roll 31 with adhesive tape, before the photosensitive material strip roll 31 is inserted respectively in the wrapper or bag 32. A bag mouth of the wrapper or bag 32 is tightly enclosed by folding and attachment of adhesive tape.

Then the lower case 11 is built up. In FIG. 4, an initial board in a developed state for producing the lower case 11 is illustrated. At first, the upward extending panels 19 and 21 are bent and shaped erectly from the lower end panel 17. Then the bend flaps 19*a*, 19*b*, 21*a* and 21*b* are bent at 90 degrees. After this, the upward extending panels 18 and 20 are bent and shaped erectly from the lower end panel 17. Then the middle folding panels 22 and 23 are folded toward the inside. At this time, the bend flaps 19*a*, 19*b*, 21*a* and 21*b* are nipped between the middle folding panels 22 and 23 and the upward extending panels 18 and 20. Thus, the upward extending panels 18–21 are formed in an erect shape on the periphery of the lower end panel 17.

Then the laminate paper board 12 is inserted into the lower end panel 17, to reinforce a lower side of the package. The laminate paper board 12 has such a relatively small size obtained by subtracting a thickness of the upward extending panels 18–21 from the size of the lower end panel 17. Note that the laminate paper board 12 may be placed before the folding of the middle folding panels 22 and 23 toward the center. For such a case, the laminate paper board 12 has a slightly larger size so as to be fitted on the middle folding panels 22 and 23 for positioning. This is preferable because the laminate paper board 12 is kept from dropping away from the lower case 11.

Figure 7:
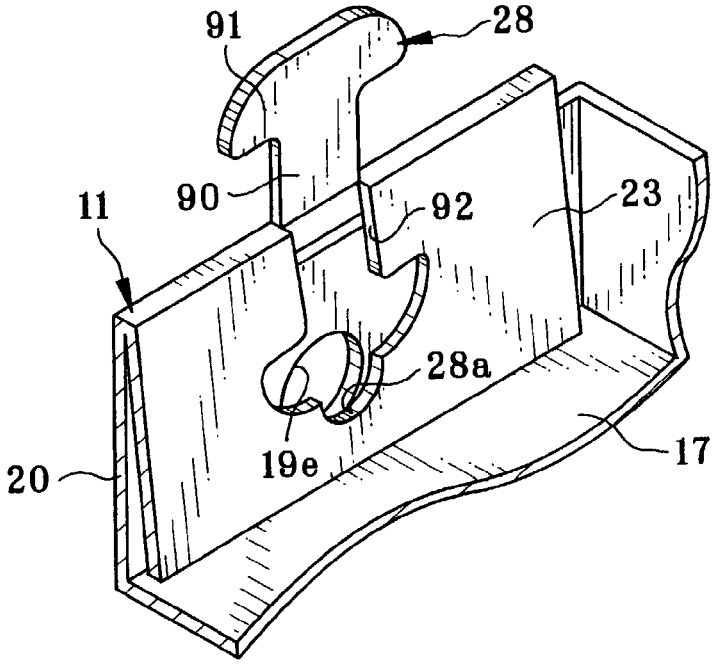
FIG. 7 is a perspective, partially broken, illustrating a connection tab bent away from the middle folding panel.

After the laminate paper board 12 is inserted, the connection tabs 25–28 are pulled up from the middle folding panels 22 and 23. The access recesses 25*a*, 26*a*, 27*a* and 28*a* in the middle folding panels 22 and 23 are exactly positioned at the access holes 19*e*, 19*f*, 21*e* and 21*f* in the bend flaps 19*a*, 19*b*, 21*a* and 21*b*. Therefore, a space for inserting fingers can be kept wide. In FIG. 7, it is possible to pull up the connection tabs 25–28 reliably with respect to the cut lines 92. As the connection tabs 25–28 are pulled up, those do not enter the inside of the lower case 11 at the time of mounting the lateral section 14.

A predetermined number of the roll containing wrappers 30 are gathered, and laid on the laminate paper board 12 in an overlaid manner on one another. Then the board materials 34 and 35 are combined by horizontal movement toward the roll containing wrapper group 13, and form the lateral section 14. A lower end of the lateral section 14 is set on a portion inside of the middle folding panels 22 and 23. After this, portions which will become the gap closing projections 81 in the reinforcing panel portions 34*a*, 34*c*, 35*a* and 35*c* are cut open by cutting along the cut line 80, to create the through holes 37–44.

Figure 8:
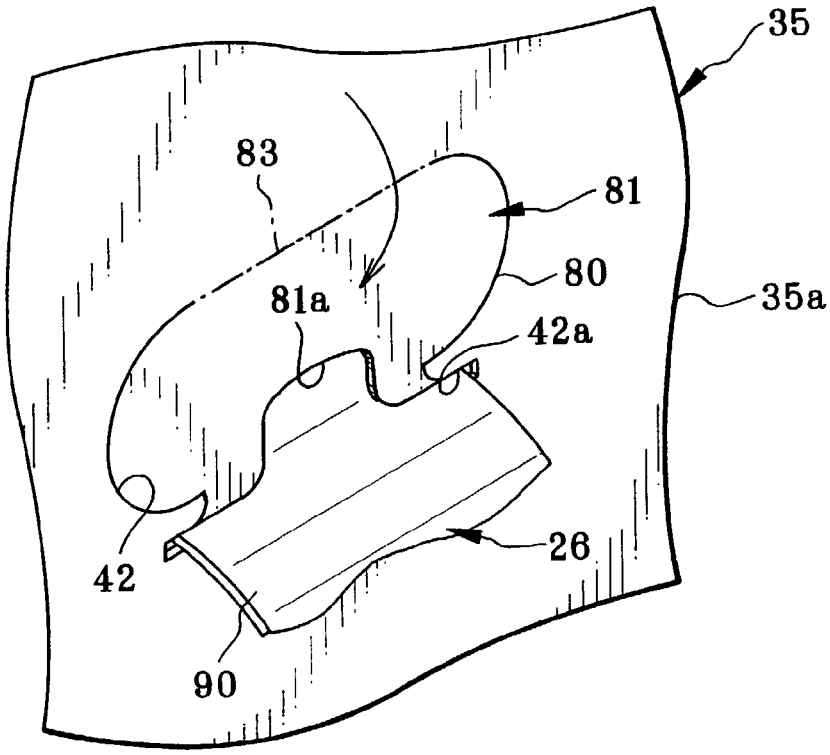
FIG. 8 is a perspective, partially broken, illustrating the through hole closed after insertion of the connection tab.

In the present invention, the gap closing projections 81 are previously pushed open at overlapped portions in the reinforcing panel portions 34*a* and 35*c*. Note that, instead of this, it is not necessary to push open all of the gap closing projections 81 previously because the gap closing projections 81 of the reinforcing panel portions 34*a* and 35*c* and of the reinforcing panel portions 34*c* and 35*a* are overlapped on one another. Those included in the gap closing projections 81 of the through holes 37, 38, 43 and 44 disposed at inner positions can be pressed to push open remaining ones of the gap closing projections 81 of the through holes 39, 40, 41 and 42 disposed at outer positions. Note that in the present embodiment, the gap closing projections 81 of each of the reinforcing panel portions 34*c* and 35*a* can be pushed open in an outward direction. The gap closing projections 81 of each of the reinforcing panel portions 34*a* and 35*c* can be pushed open in an inward direction. Then the connection tabs 25–28 of the lower case 11 are inserted into respectively the through holes 37–44. After the insertion, the support portion 90 is fitted in the retention gap portion 42*a*. The gap closing projection 81 is returned to the initial position as illustrated in FIG. 8, to close each of the through holes 37–44. The hook portion 91 is kept positioned inside the reinforcing panel portions 34*a* and 35*c*. Also, the gap closing projection 81 pushes the support portion 90, to ensure fixation of the connection tabs 25–28.

Finally, the upper case 15 or upper end panel is fitted on the top of the lateral section 14. The upper case 15 with the downward extending panels 71, 73 and 74 has an identical shape with that of the lower case 11 with the upward extending panels 18–21. At the time of use for the upper case 15, there is no bending out of the connection tabs 25–28 of the upper case 15. When the upper case 15 is placed on the lateral section 14, the roll package 10 is finally obtained. The roll package 10 being obtained is transferred to a warehouse or other product reserving stations. If a package according to the prior art is transferred, collapse of the roll containing wrappers 30 is likely to occur. However, the lateral section 14 in the present invention is reliably fastened to the lower case 11 with sufficient firmness. Therefore, collapse of the roll containing wrappers 30 in the package can be prevented. The board materials 34 and 35 are kept oriented exactly in a regular shape by the use of the connection tabs 25–28. This can obtain the highest strength or resistance to weight in laying plural packages on one another as viewed in a vertical direction.

To ensure strength or resistance to weight in laying plural packages on one another, the combined structure of the roll containing wrappers 30 and the lateral section 14 having the board materials 34 and 35 is used. A space of a predetermined size is formed between the product and the upper case 15 or upper end panel, so weight of additional packages laid thereon will not influence the package. Also, the gap closing projections 81 are closed after the insertion to keep the connection tabs 25–28 retained. Thus, the through holes 37–44 are closed to prevent entry of dust or other foreign material. Furthermore, the through holes 45–52 formed in upper portions of the lateral section 14 are used specifically when the package is conveyed on a vehicle or manually conveyed by dragging, as fingers can capture any of the through holes 45–52. Also, the lower case 11 may be placed on a pallet of containerboard or wooden material for the purpose of packaging operation.

In the operation of tearing open the roll package, the tear lines 29 and 75 are torn by pulling the strip ends on lateral faces of the lower case 11 and the upper case 15 or upper end panel. Thus, a lower portion of the downward extending panel 71 in the upper case 15 as viewed with reference to the tear lines 75 is separated from the upper case 15. On the other hand, an upper portion of the upward extending panel 18 in the lower case 11 as viewed with reference to the tear lines 29 is separated from the lower end panel 17. As has been described heretofore, the upper portion of the upward extending panel 18 has the connection tabs 25 and 26 protruding therefrom. The connection tabs 25 and 26 are inserted in the through holes 42 and 43. Finally in the disassembly operation, the connection tabs 25 and 26 are removed from the through holes 42 and 43. The upper portion of the upward extending panel 18 can be separated together with the connection tabs 25 and 26.

When the upward extending panel 18 and the downward extending panel 71 are partially removed, the reinforcing panel portion 35*a* of the board material 35 appears. After this, the reinforcing panel portion 35*a* is pulled out, before the reinforcing panel portion 34*a* of the board material 34 is pulled out. The reinforcing panel portions 34*a* and 35*a* are opened in a manner of a clamshell door, so the roll containing wrapper group 13 appears externally. So the roll containing wrappers 30 can be removed easily. The roll containing wrappers 30 can be moved horizontally in the removal. This makes it possible to remove the roll containing wrappers 30 rapidly, because the removal is possible even if other objects lie on the upside of the roll package 10. Thus, the feature of the embodiment is advantageous typically in comparison with different techniques in which the upper case 15 is moved up for the removal, or in which a one-piece panel set is used, with which a large space over the top of package is required for the removing operation.

In the embodiment, let $D_{42}$, $D_{42a}$, $D_{90}$, $D_{91}$ be sizes of a largest passage gap portion of each of the through holes 37–44, the retention gap portion 42*a*, the support portion 90 and the hook portion 91 in the horizontal direction. Those elements are required to satisfy the condition of:

$$D_{90} \leqq D_{42a} < D_{91} < D_{42}$$

However, it is possible in the invention to omit the passage gap portion with the greater size from each of the through holes 37–44. The retention gap portion 42*a* with the size as depicted may be formed, into which the hook portion 91 may be inserted forcibly for firm retention.

EXAMPLES

A preferable example of containerboard for the board materials 34 and 35 is double-wall containerboard. In general, the double-wall containerboard consists of single-face containerboard, and double-face containerboard being single-wall containerboard, which is attached to the single-face containerboard. A corrugating medium included in the double-face containerboard according to the Example has a structure of A-flute defined in JIS:Z1516. A corrugating medium included in the single-face containerboard according to the Example has a structure of B-flute. Specifics of containerboards for the board materials 34 and 35 according to the Example are indicated in the Table as follows.

[Specifics of the Board Materials 34 and 35]

| | |
|---|---|
| External linerboard in the double-face containerboard | A-class, basis weight of 280 or 320 g/m$^2$ |
| Corrugating medium in the double-face containerboard | Reinforced medium, basis weight of 200 g/m$^2$ |
| Internal linerboard in the double-face containerboard | A-class, basis weight of 280 or 320 g/m$^2$ |
| Corrugating medium in the single-face containerboard | Reinforced medium, basis weight of 200 g/m$^2$ |
| Linerboard in the single-face containerboard | A-class, basis weight of 280 g/m$^2$ |

In the table, the term "A-class" means a board element of which principal raw material is kraft pulp.

Also, a preferable example of containerboard for the lower case 11 and the upper case 15 or upper end panel is double-face containerboard. A corrugating medium included in the double-face containerboard according to the Example has a structure of B-flute defined in JIS:Z1516. Specifics of the containerboard for the lower case 11 and the upper case 15 according to the Example are indicated in the Table as follows.

[Specifics of Materials for the Lower Case 11 and the Upper Case 15]

| | |
|---|---|
| External linerboard in the double-face containerboard | A-class, basis weight of 280 g/m$^2$ |
| Corrugating medium in the double-face containerboard | Reinforced medium, basis weight of 120 g/m$^2$ |
| Internal linerboard in the double-face containerboard | A-class, basis weight of 280 g/m$^2$ |

In the above embodiment, the strip rolls are a roll of the photosensitive material, which is typically a motion picture photo film. Other examples of strip materials to be packaged according to the invention include color photographic paper, microfilm, photo typesetting paper, photo film for still photography, COM film, thermosensitive paper, thermosensitive film, photosensitive resin film, and heat-developing thermosensitive material. Furthermore, strip materials may be magnetic recording material, pressure-sensitive recording paper, decorative ribbon, and the like. The reel in the rolls is plastic according to the embodiments, but may be produced from metal, containerboard, or the like.

Figure 9:
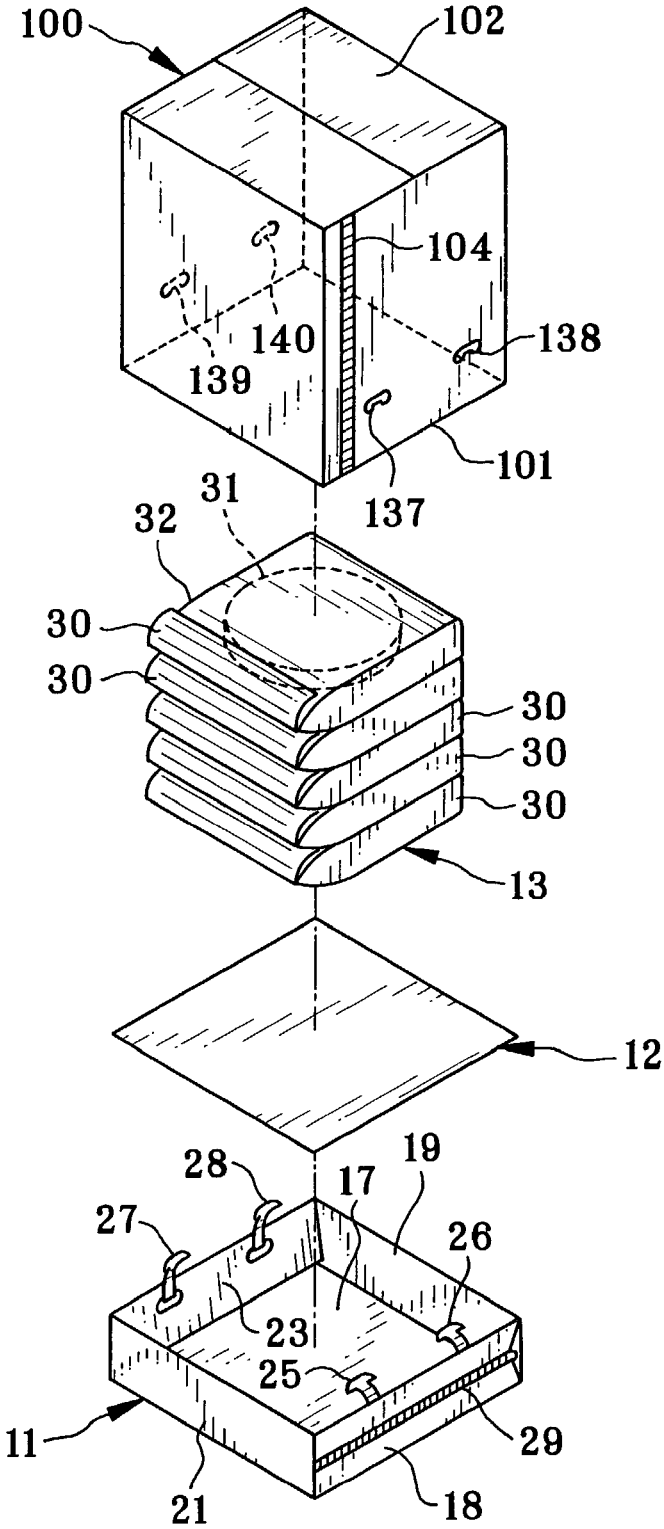
FIG. 9 is an exploded perspective illustrating another preferred roll package in which a unified container case including an upper end panel and side panels.

In the above embodiment, the lateral section 14 and the upper case 15 or upper end panel are used. However, it is possible to use an upper case in which the lateral section 14 and the upper case 15 are initially combined for the purpose of reducing a manufacturing cost. In FIG. 9, a container case 100 has a shape of a quadrangular prism, and has a case opening 101 that is open in a downward direction. An upper end panel 102 is included in the container case 100, and is constituted by inner flaps and outer flaps overlapped thereon in a closed shape. A pair of tear lines 104 or perforated lines are formed in one side panel of the container case 100 and extend vertically. When a strip portion defined between the tear lines 104 is pulled and torn away, the container case 100 can be destroyed, to remove the roll containing wrappers 30 by movement in a horizontal direction. There are through holes 137–140 formed in the container case 100 by operation of punching, for receiving insertion of the connection tabs 25–28. In a manner similar to the embodiment above, the container case 100 have such a height as to extend slightly higher than the roll containing wrapper group 13. So weight of additional packages laid on the package of FIG. 9 will not influence the latter.

In the present embodiment, the tear lines 104 are used. Alternatively, the container case 100 may have a one-piece shape including overlapping connection margins at a lateral face. The overlapping connection margins can be attached according to pseudo adhesion. At the time of opening the package, the overlapping connection margins can be peeled, so that the roll containing wrappers can be removed by horizontal movement to the outside. Furthermore, an inserting structure may be used instead of using the overlapping connection margins.

Figure 10:
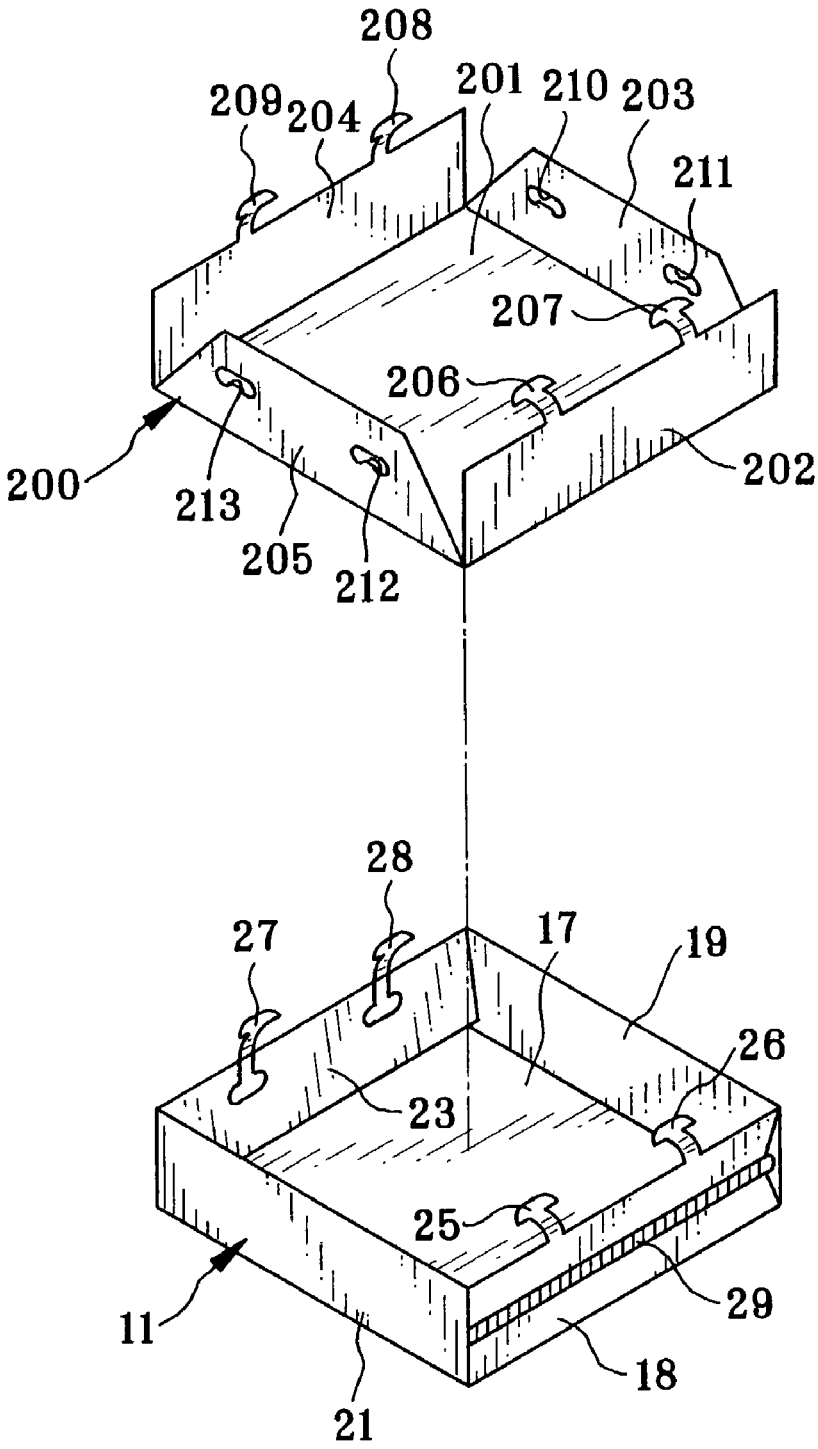
FIG. 10 is an exploded perspective illustrating still another preferred embodiment in which the connection tabs are reinforced.
Figure 11:
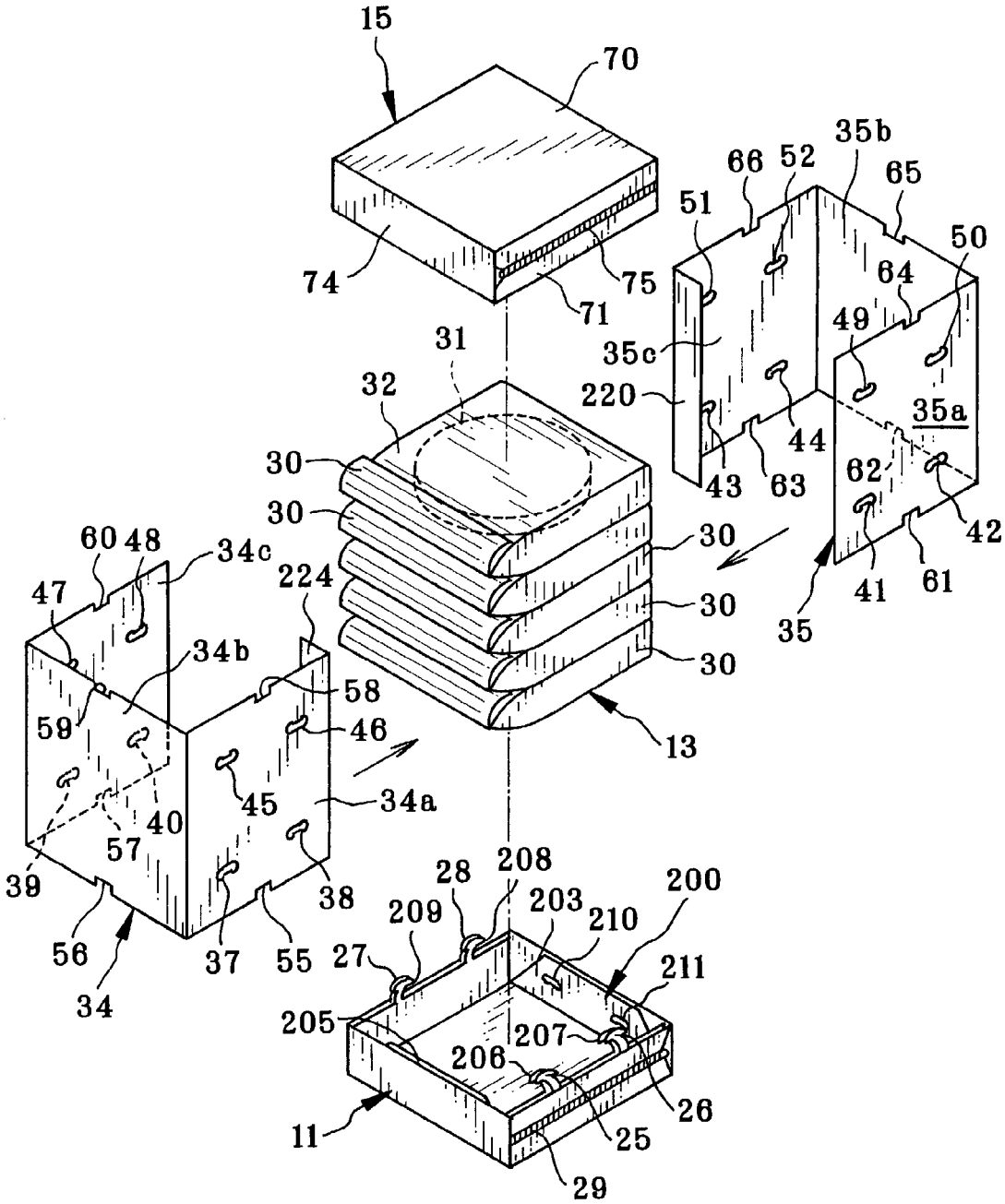
FIG. 11 is an exploded perspective illustrating a roll package of the embodiment of FIG. 10.

The lower case 11 is weighed by the weight of the roll containing wrappers 30 under gravity. Should a user hold and raise the lateral section 14 manually, it is likely that the connection tabs 25–28 are broken away from the upward extending panels 18 and 20. In order to avoid such a difficulty, it is preferable to reinforce the connection tabs 25–28 by a double structure. In FIGS. 10 and 11, a lower pad device 200 is placed on the inner surface of the lower case 11, having a smaller size than the lower end panel 17 of the lower case 11. The lower pad device 200 includes a reinforcing pad sheet 201, two pad flaps 202 and 204, and four reinforcing tabs 206–209. The pad flaps 202 and 204 are formed on the reinforcing pad sheet 201 and shaped erectly from its two sides opposed to each other. The reinforcing tabs 206 and 207 are formed on a free end of the pad flap 202. The reinforcing tabs 208 and 209 are formed on a free end of the pad flap 204.

Figure 12:
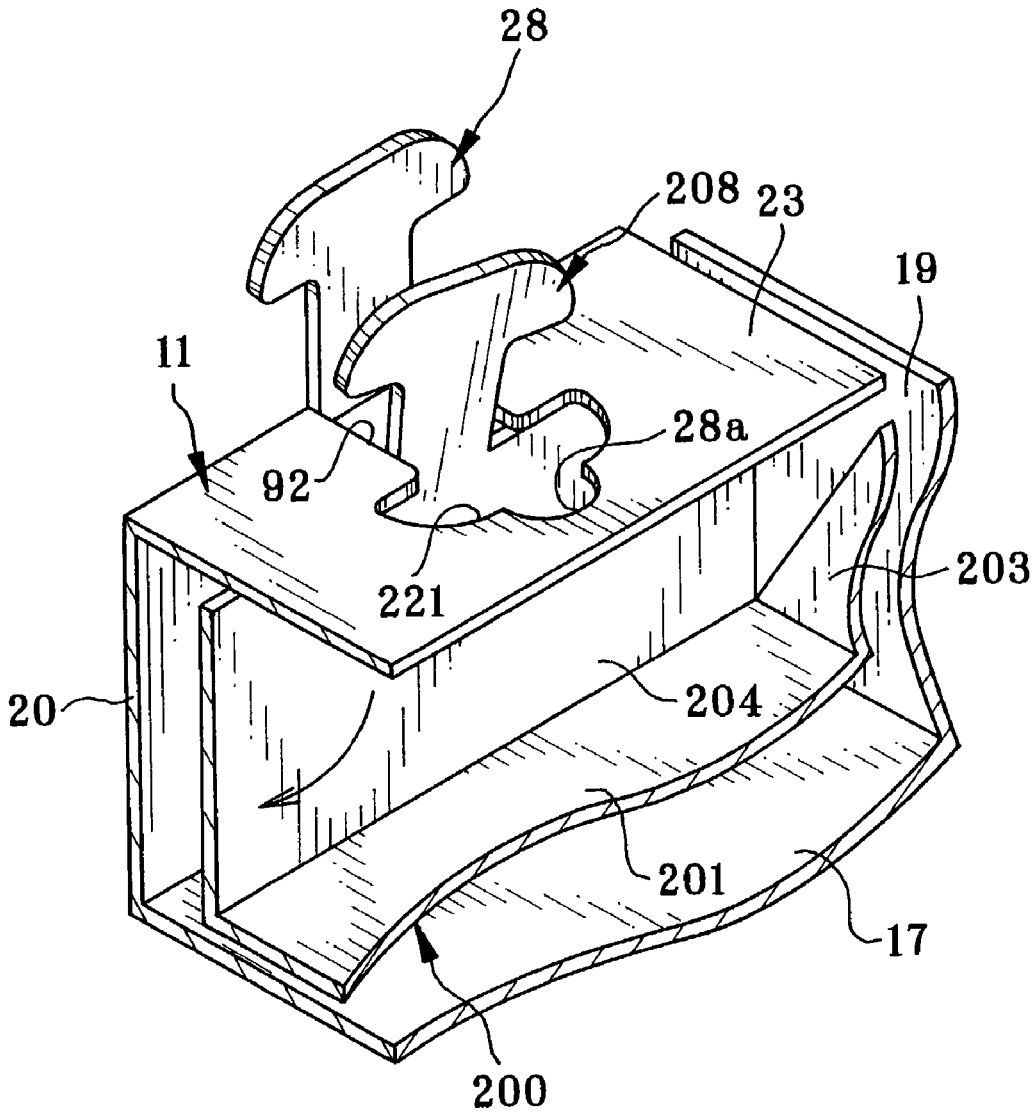
FIG. 12 is a perspective, partially broken, illustrating one of the connection tabs and a tab for reinforcement.

When the lower pad device 200 is inserted in the lower case 11 to place the reinforcing pad sheet 201 on the lower end panel 17, the reinforcing tabs 206–209 are fitted respectively on the inside of the connection tabs 25–28 of the lower case 11. The reinforcing tabs 206–209 and the connection tabs 25–28 as combined as pairs are inserted into the through holes 37–44, so that the lower case 11 can be kept connected with the lateral section 14 firmly. In FIG. 12, a hole 221 is formed in the middle folding panels 22 and 23 after bending out the connection tab 28 defined by the cut lines 92. Each of the connection tabs 25–28 is inserted into the hole 221, so that the connection tabs 25–28 are overlapped on the reinforcing tabs 206–209, to prevent offsetting of the lower pad device 200 from the lower case 11.

Note that it is unnecessary to insert each of the reinforcing tabs 208 in the hole 221. It is possible to fold the middle folding panel 23, and then to fit the pad flap 204 on the middle folding panel 23. The reinforcing tab 208 may be simply overlapped on the connection tab 28 without using the hole 221.

Figure 13:
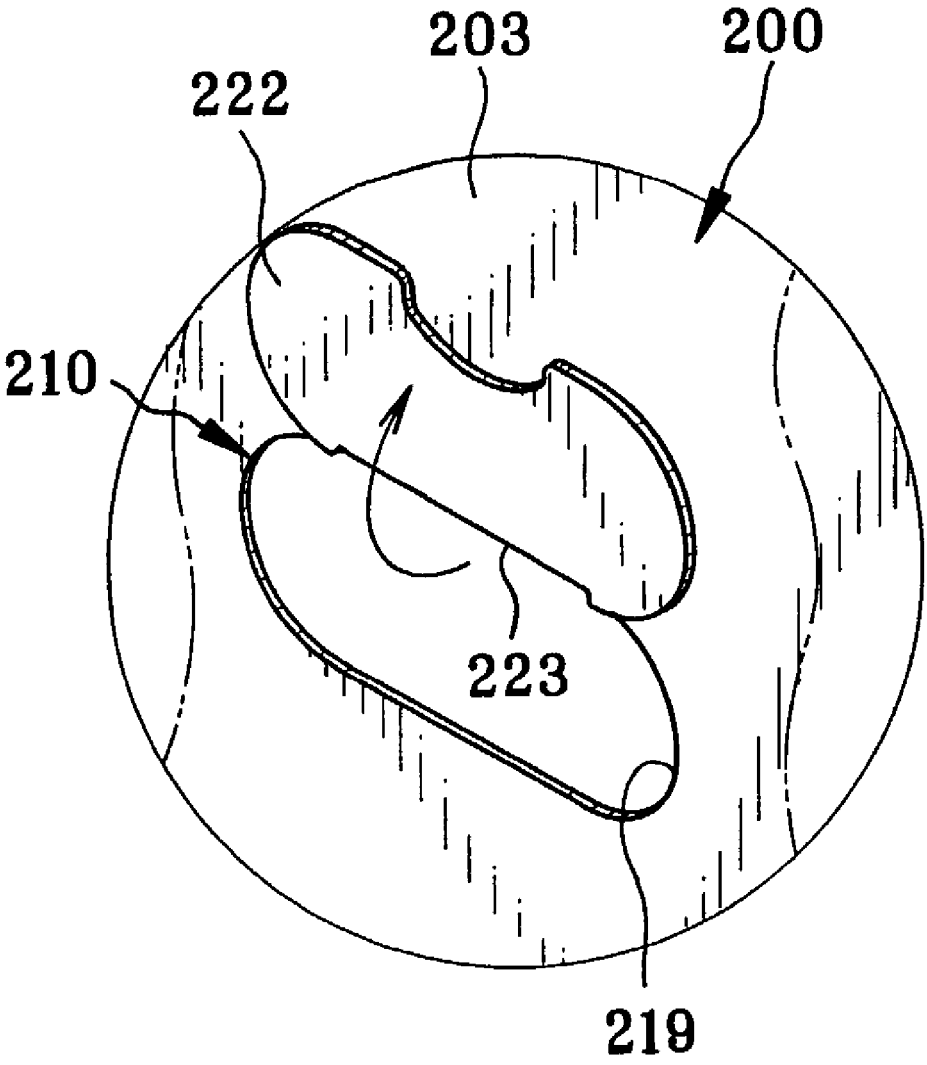
FIG. 13 is a perspective, partially broken, illustrating forming an access hole in a pad sheet.

If the reinforcing tabs 206–209 and the connection tabs 25–28 are broken accidentally, the lower pad device 200 must be exchanged for mounting the roll containing wrapper group 13 again. To this end, flaps 203 and 205 are formed on the reinforcing pad sheet 201 at portions not having the reinforcing tabs 206–209. Access holes 210–213 are formed in the flaps 203 and 205. When the lower case 11 is disassembled, the access holes 210–213 are manually held to slip out or take out the lower pad device 200. This makes it easy to exchange the lower pad device 200, because the lateral section 14, the roll containing wrapper group 13 and the upper case 15 can be dragged together. It is further preferable as illustrated in FIG. 13 to form a perforated tear line 219 or cut line in the flap 203. A cut-open portion 222 can be formed by cutting the perforated tear line 219, and can be open. As the cut-open portion 222 is bent upwards, a bend line 223 is touched by a palm of a user's hand without touching the cut end or the perforated tear line 219 if the hand holds the lower pad device 200. There occurs no accident of scratching or injuring the hand.

Furthermore, the use of the lower pad device 200 makes it possible to eliminate the laminate paper board 12 of FIG. 1. To keep a high strength of the lateral section 14, flaps 220 and 224 of a small length are formed on the reinforcing panel portions 34*a* and 35*c* of the board materials 34 and 35 having a channel shape as viewed in section. See FIG. 11. When the board materials 34 and 35 are combined with one another by opposing portions of free ends of the reinforcing panel portions 34*a* and 35*c*, the reinforcing panel portion 34*a* with the flap 224 is positioned inside the reinforcing panel portion 35*a*. The reinforcing panel portion 35*c* with the flap 220 is positioned inside the reinforcing panel portion 34*c*. According to this structure, weight of the upper case 15 and objects laid on the upper case 15 can be borne firmly by the L-shaped bent portions including the flaps 220 and 224 and the reinforcing panel portions 34*a* and 35*c*.

In the above embodiments, the reinforcing panel portion 34*a* of the board material 34 is positioned inside the reinforcing panel portion 35*a* of the board material 35. The reinforcing panel portion 34*c* is positioned outside the reinforcing panel portion 35*c*. However, the board materials 34 and 35 may be so combined as to position both of the reinforcing panel portions 34*a* and 34*c* outside the reinforcing panel portions 35*a* and 35*c*, or inside the same.

In the above embodiments, the tear lines 29, 75 and 104 are pairs of perforated lines. However, a tear portion of each of the panels may be provided with a single perforated tear line. A hand or suitable tool may be used to push the single perforated tear line strongly, to push open the upward extending panels 18, 71 or the container case 100.

Although the present invention has been fully described by way of the preferred embodiments thereof with reference to the accompanying drawings, various changes and modifications will be apparent to those having skill in this field. Therefore, unless otherwise these changes and modifications depart from the scope of the present invention, they should be construed as included therein.

What is claimed is:

1. A packaging container for containing a roll group constituted by a stack of plural rolls of strip material, comprising:

a lower case section for placement of said roll group thereon;

a lateral section disposed about said roll group, having a lower portion fitted on said lower case section;

an upper case section for covering an upper portion of said roll group;

plural through holes formed in said lateral section; and plural connection tabs, formed by cutting a portion of said lower case section along cut lines, to extend from an upper end of said lower case section, for being inserted in said through holes to connect said lower case section with said lateral section, wherein each of said through holes includes a passage gap portion and a retention gap portion having a smaller width than said passage gap portion, wherein said connection tabs respectively include a small-width support portion and a large-width hook portion, and are in a T-shape, wherein said passage gap portion receives insertion of said hook portion of said connection tabs, said support portion of said connection tab being pressed into said retention gap portion, and wherein said through holes are formed by bending out a region defined by a partially closed loop of a cut line, and after said support portion is retained in said retention gap portion, said region is bent back to said cut line to close said passage gap portion.

2. A packaging container as defined in claim 1, wherein said lower case section, said lateral section and said upper case section are formed from containerboard.

3. A packaging container as defined in claim 2, wherein said lower case section includes:

a lower end panel in a substantially quadrilateral shape; and first to fourth upward extending panels, disposed to project from side lines of said lower end panel, oriented erectly from said lower end panel by board bending, said first and third upward extending panels being opposed to one another, said second and fourth upward extending panels being opposed to one another.

4. A packaging container as defined in claim 3, wherein each of said first and third upward extending panels are folded inwardly along a respective folding line, such that each respective first and third upward extending panel forms a middle folding panel and an external portion connected along the folding line.

5. A packaging container as defined in claim 4, further comprising a zipper-shaped tear line, formed in said external portion, for being torn to cut said external portion into two, wherein each of said connection tabs is formed with said middle folding panel.

6. A packaging container as defined in claim 3, wherein said lateral section includes:

a first channel shaped board material, shaped in a channel form, and including a first panel portion, and second and third panel portions for protruding from lateral sides of said first panel portion; and a second channel shaped board material, shaped in a channel form, and including a fourth panel portion, and fifth and sixth panel portions for protruding from lateral sides of said fourth panel portion;

wherein said second panel portion is overlapped with said sixth panel portion, and said third panel portion is overlapped with said fifth panel portion.

7. A packaging container as defined in claim 6, wherein said lower case section except for said connection tabs is shaped equally to said upper case section.

8. A packaging container as defined in claim 6, wherein said upper case section includes faces and a zipper-shaped tear line formed in at least one of said faces for tearing and destruction.

9. A packaging container as defined in claim 6, further comprising a lower pad device fitted in said lower case section, including:

a reinforcing pad sheet placed on said lower end panel;

a pair of pad flaps disposed to extend from two side lines of said reinforcing pad sheet opposed to one another, and oriented erectly from said reinforcing pad sheet; and plural reinforcing tabs, formed with said pad flaps, overlapped with said connection tabs, for being inserted in said through holes.

10. A packaging container as defined in claim 2, wherein said lateral section is formed to extend from said upper case section.

11. A packaging container as defined in claim 10, wherein said lateral section includes a zipper-shaped tear line for tearing and destruction.

12. A packaging container for containing a roll group constituted by a stack of plural rolls of strip material, comprising:

a lower case section for placement of said roll group thereon;

a lateral section disposed about said roll group, having a lower portion fitted on said lower case section;

an upper case section for covering an upper portion of said roll group;

plural through holes formed in said lateral section; and plural connection tabs to extend from an upper end of said lower case section, for being inserted in said through holes to connect said lower case section with said lateral section, wherein each of said through holes includes a passage gap portion and a retention gap portion having a smaller width than said passage gap portion, wherein said connection tabs respectively include a small-width support portion and a large-width hook portion, and are in a T-shape, wherein said passage gap portion receives insertion of said hook portion of said connection tabs, said support portion of said connection tab being pressed into said retention gap portion, and wherein said through holes are formed by bending out a region defined by a partially closed loop of a cut line, and after said support portion is retained in said retention gap portion, said region is bent back to said cut line to close said passage gap portion.

13. A packaging container for containing a roll group constituted by a stack of plural rolls of strip material, comprising:

a lower case section for placement of said roll group thereon, said lower case section having a lower end panel;

a lateral section disposed about said roll group, having a lower portion fitted on said lower case section;

an upper case section for covering an upper portion of said roll group;

plural through holes formed in said lateral section;

plural connection tabs to extend from an upper end of said lower case section, for being inserted in said through holes to connect said lower case section with said lateral section; and a lower pad device fitted in said lower case section, said lower pad device comprising:

a reinforcing pad sheet placed on said lower end panel;

a pair of pad flaps disposed to extend from two side lines of said reinforcing pad sheet opposed to one another, and oriented erectly from said reinforcing pad sheet; and plural reinforcing tabs, formed with said pad flaps, overlapped with said connection tabs, for being inserted in said through holes.

* * * * *